US005576811A

United States Patent [19]

Kobayashi et al.

[11] Patent Number: 5,576,811

[45] Date of Patent: Nov. 19, 1996

[54] IMAGE RECORDING APPARATUS FOR CONTROLLING IMAGE IN HIGH QUALITY AND IMAGE QUALITY CONTROL METHOD THEREOF

[75] Inventors: Shinya Kobayashi, Mito; Kunio Sato, Hitachi; Katsuhiro Ono, Hitachinaka, all of Japan

[73] Assignee: Hitachi, Ltd., Tokyo, Japan

[21] Appl. No.: 407,516

[22] Filed: Mar. 16, 1995

[30] Foreign Application Priority Data

Mar. 18, 1994 [JP] Japan ..... 6-048237

[51] Int. Cl.[6] ..... G03G 21/00

[52] U.S. Cl. ..... 355/246; 355/208

[58] Field of Search ..... 355/200, 203, 355/204, 208, 210, 245, 246

[56] References Cited

U.S. PATENT DOCUMENTS

| | | | |
|---|---|---|---|
| 4,866,481 | 9/1989 | Yamada et al. | 355/246 |
| 4,888,618 | 12/1989 | Ishikawa | 355/208 |
| 4,894,685 | 1/1990 | Shoji | 355/246 |
| 4,967,211 | 10/1990 | Colby et al. | 355/246 X |
| 5,122,835 | 6/1992 | Rushing et al. | 355/208 |
| 5,250,988 | 10/1993 | Matsuura et al. | 355/208 |

FOREIGN PATENT DOCUMENTS

| | | |
|---|---|---|
| 61-286865A | 12/1986 | Japan . |
| 62-145266A | 6/1987 | Japan . |
| 63-253383A | 10/1988 | Japan . |
| 293667A | 4/1990 | Japan . |

*Primary Examiner*—Sandra L. Brase
*Attorney, Agent, or Firm*—Kenyon & Kenyon

[57] ABSTRACT

An image recording apparatus that records a visible image on a recording medium by successively entering image signals forming an image. The apparatus comprises a standard pattern detector detecting standard patterns from the input image signals, image density measuring device measuring density of an output signal, image quality judging device judging image quality of every standard pattern output of the image density measuring device, and process controller deciding process parameters on the basis of signals output of the image quality judging device before controlling image quality of the output signal using the process parameters. The apparatus therefore can save the toner and paper and control for high image quality.

13 Claims, 13 Drawing Sheets

201
HORIZONTAL SYNC SIGNAL
503
VERTICAL SYNC SIGNAL
505
MICROCOMPUTER
504
LATCH
CLK
506
LATCH SIGNAL
RES
Q
D
CLK
COINCIDENCE SIGNAL 502
LOGIC CIRCUIT 501
PIXEL ADDRESS PAD
TEMPLATE 1
TEMPLATE 2
TEMPLATE 12
PIXEL SYNC SIGNAL 203
CMYK LOCAL IMAGE 1101

IMAGE RECORDING APPARATUS FOR CONTROLLING IMAGE IN HIGH QUALITY AND IMAGE QUALITY CONTROL METHOD THEREOF

BACKGROUND OF THE INVENTION

The present invention relates to an image recording apparatus and image quality control method. More particularly, it concerns an image recording apparatus and image quality control method for obtaining a quality image.

To automatically maintain high quality of an image output of an image recording apparatus, the image must be monitored in some methods not to deteriorate. The methods include the following known techniques.

The Japanese Patent Laid-Open Nos. 63-253383 and 2-93667 disclosed apparatuses that developed a patch pattern and thin lines on a non-image area of a photosensitizer as standard pattern. The standard pattern was read by a photosensor or the like so that the image to be recorded could be monitored. The Japanese Patent Laid-Open No. 62-145266 disclosed an apparatus that developed a standard pattern on an image area of a photosensitizer before transferring the standard pattern to paper. Quality of the image transferred on the paper was monitored by a line density sensor. The Japanese Patent Laid-Open No. 61-1286865 disclosed an apparatus that fixed an image on paper. The image fixed on the paper is measured by a line density sensor.

However, the apparatuses disclosed by the Japanese Patent LaidOpen Nos. 63-253383 and 2-93667 have to develop the patch pattern having different densities and to develop the standard pattern of vertical and horizontal thin lines in addition to the image to be recorded by a user. If the standard pattern is created for every page, toner consumption is greater. If the number of standard patterns created is decreased to every several pages to lessen the toner consumption, then response of control becomes worse. The image quality become unstable. The apparatus disclosed in the Japanese Patent Laid-Open No. 62-145266 has the advantage that the image quality, including characteristics of transference and fixing processes after development, can be stabilized. However, the apparatus has not only the above-mentioned disadvantage, but also the disadvantage that paper is wasted and the printing speed by user is reduced. The apparatus disclosed in the Japanese Patent Laid-Open No. 61-1286865 does not have the above-mentioned disadvantages because the standard pattern is note used. However, the apparatus cannot measure any densities except an average density of the entire output image. The apparatus has lower control capability than the one that can monitor the patch pattern having different densities and the standard pattern of vertical and horizontal thin lines.

SUMMARY OF THE INVENTION

In view of solving the foregoing problems of the prior art, it is an object of the present invention to provide an image recording apparatus and image quality control method that can monitor patch patterns having different densities of single colors and image qualities of vertical and horizontal thin lines to stabilize quality of an output image automatically without creating the prior standard patterns.

Another object is to judge service life of a photosensitizer and the like on the basis of the results of the above-mentioned monitoring.

Briefly, the foregoing object is accomplished in accordance with aspects of the present invention by a image recording apparatus that comprises standard pattern position detecting means for detecting positions of standard patterns from input image signals with the standard patterns and their density data stored in advance, image density measuring means for measuring density of an output signal on the basis of the position data, image quality judging means for judging image quality of every standard pattern, and process controlling means for updating process parameters on the basis of results of the judgement to control image quality of the output signal.

The pattern position detecting means for detecting the positions of the standard patterns from the input image signals compares the input image signals with the patch patterns of different densities and colors, and with the standard patters of vertical and horizontal thin lines defined in a storing means placed in an image storing device in advance. If the entire input image contains local images available as the standard patterns, the pattern position detecting means detects the kinds of corresponding standard patterns and positions of the local images in the input image. The image density measuring means for measuring the density of the output signal on the basis of the position data knows with the position data that the local images in the input image are recorded on paper and comes to image measuring positions. The image density measuring means then measures the optical densities of the local image recorded on the paper. The image quality judging means for judging the image quality of every standard pattern makes the image process of the measured local image densities depending on the kinds of corresponding standard patterns before judging deteriorations of the image qualities. The process controlling means for updating the process parameters to control the image quality of the output signal restores the deteriorated image qualities to the original images by updating the process parameters that affect the image quality of the output image. The process controlling means also can judge the service life in terms of the degree of restoration of the deteriorated image quality.

The present invention searches the standard patterns from among the input image signals to record, but does not need to create special standard patterns. The present invention therefore saves the toner and paper, and does not increase load on the cleaner. Because there is no limit to number of the standard patterns defined in the devices in advance, evaluation of the image qualities of variety of images can be made. If the input images created by the user merely continue to have no local images available as standard patterns, it is not possible to control the image qualities of the images measured with the standard patterns. For the reason, a learning function is added. The image patterns used frequently are stored and indicated for the user to ask whether the they should be registered as additional patterns or not. If so, they can be additionally registered. Because the image qualities of the images recorded by the user are controlled at high priority, they can be kept at substantially high image quality.

DETAILED DESCRIPTION

Figure 1:
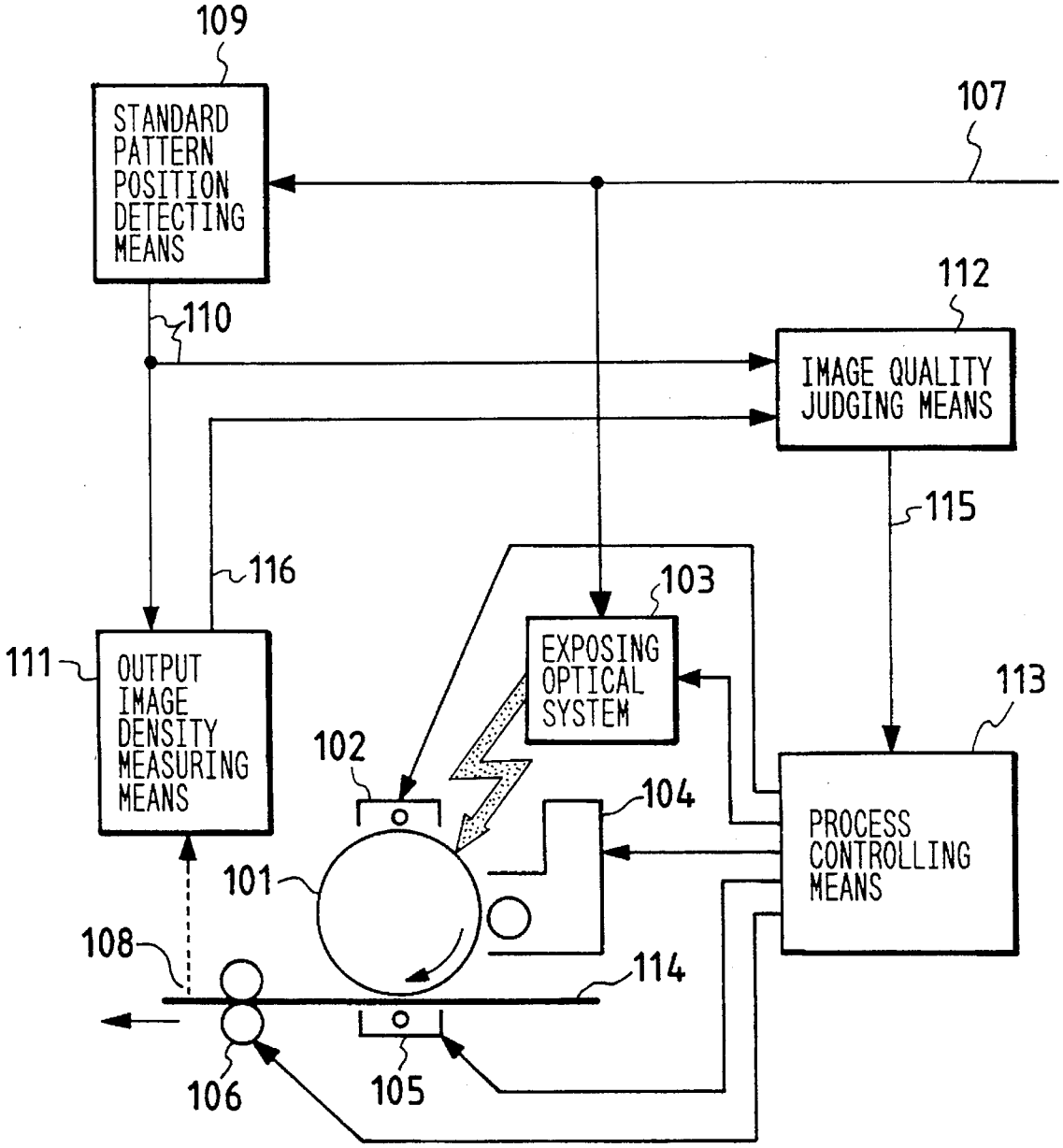
FIG. 1 is a block diagram illustrating a first embodiment of the present invention.

The following describes in detail a first embodiment according to the present invention by reference to FIGS. 1 to 7 and Tables 1 and 2. FIG. 1 depicts a block diagram illustrating the first embodiment of the present invention. The first embodiment has a monochrome laser printer used as an example of an image recording apparatus. The monochrome laser printer is formed of a cylindrical photosensitizing drum 101, a charging arrangement 102 for making uniform charging, an exposing optical system 103 including a laser, a developing arrangement 104, a transferring arrangement 105, and a fixing arrangement 106. An input image signal 107 of an original created with a word processor or personal computer by a user is fed to the exposing optical system 103. The signal then is treated in the above-mentioned process steps before being fed out as an output image 108 written on recording paper 114. Since the embodiment uses the monochrome laser printer as an example, it is assumed here that the input image signal 107 is fed sequentially line by line in the form of binary signal of white and black allotted for each pixel in the image.

This and following paragraphs describes an image control device of the present invention. The input image signal 107 is fed to a standard pattern position detecting means 109. The standard pattern position detecting means 109 has a memory (not shown) having a solid black pattern, a solid white pattern, a halftone pattern, a vertical single-line pattern, a horizontal single-line pattern, and similar standard patterns stored therein. The memory should not always be provided in the standard pattern position detecting means 109. Alternatively, the memory may be placed in the image control device and connected with the standard pattern position detecting means 109 through a signal line or bus. It is convenient that the standard patterns should be separately provided for making pattern comparison and other processes, and for making additional recording and deletion. The standard pattern position detecting means 109 consecutively checks local images clipped from the input image by pattern recognition whether or not each local image having the same pattern as any of the standard patterns exists. If the standard pattern position detecting means 109 finds the local image having the same pattern as any of the standard patterns, the standard pattern position detecting means 109 feeds data of the local image kind and position to a output image density measuring means 111 and an image quality judging means 112 as a standard pattern position table 110.

Figure 2:
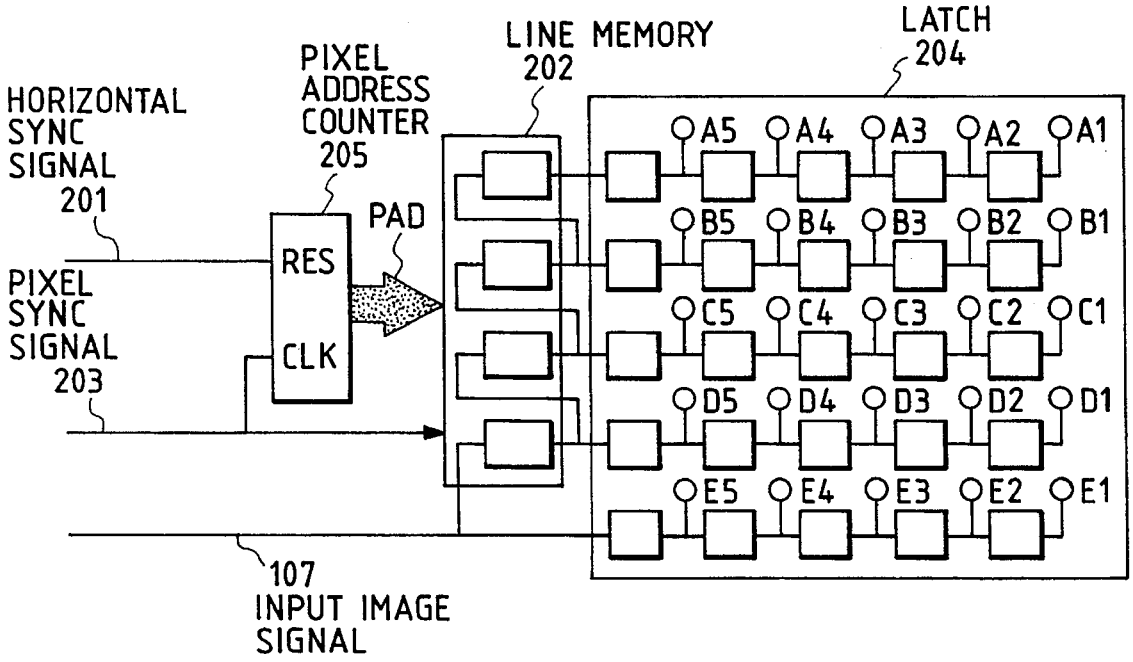
FIG. 2 is a circuit diagram illustrating a buffer memory in FIG. 1.
Figure 3:
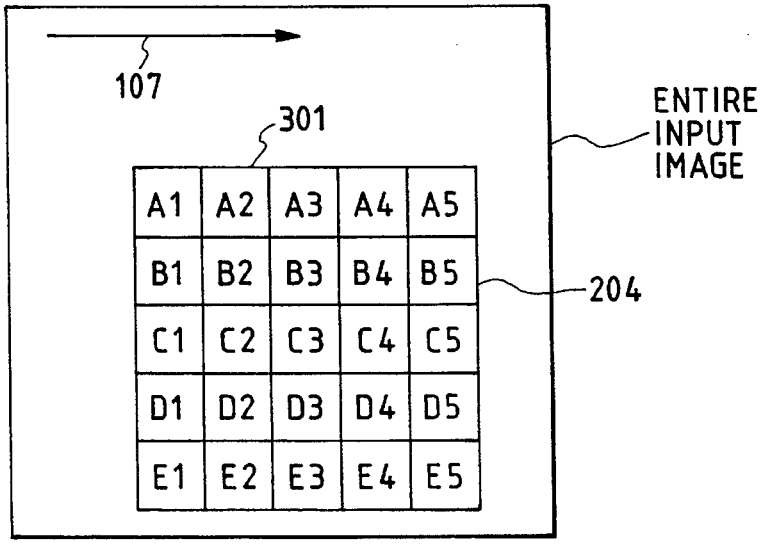
FIG. 3 is a plan view illustrating positions of data of an input image in the buffer memory in FIG. 1.
Figure 4:
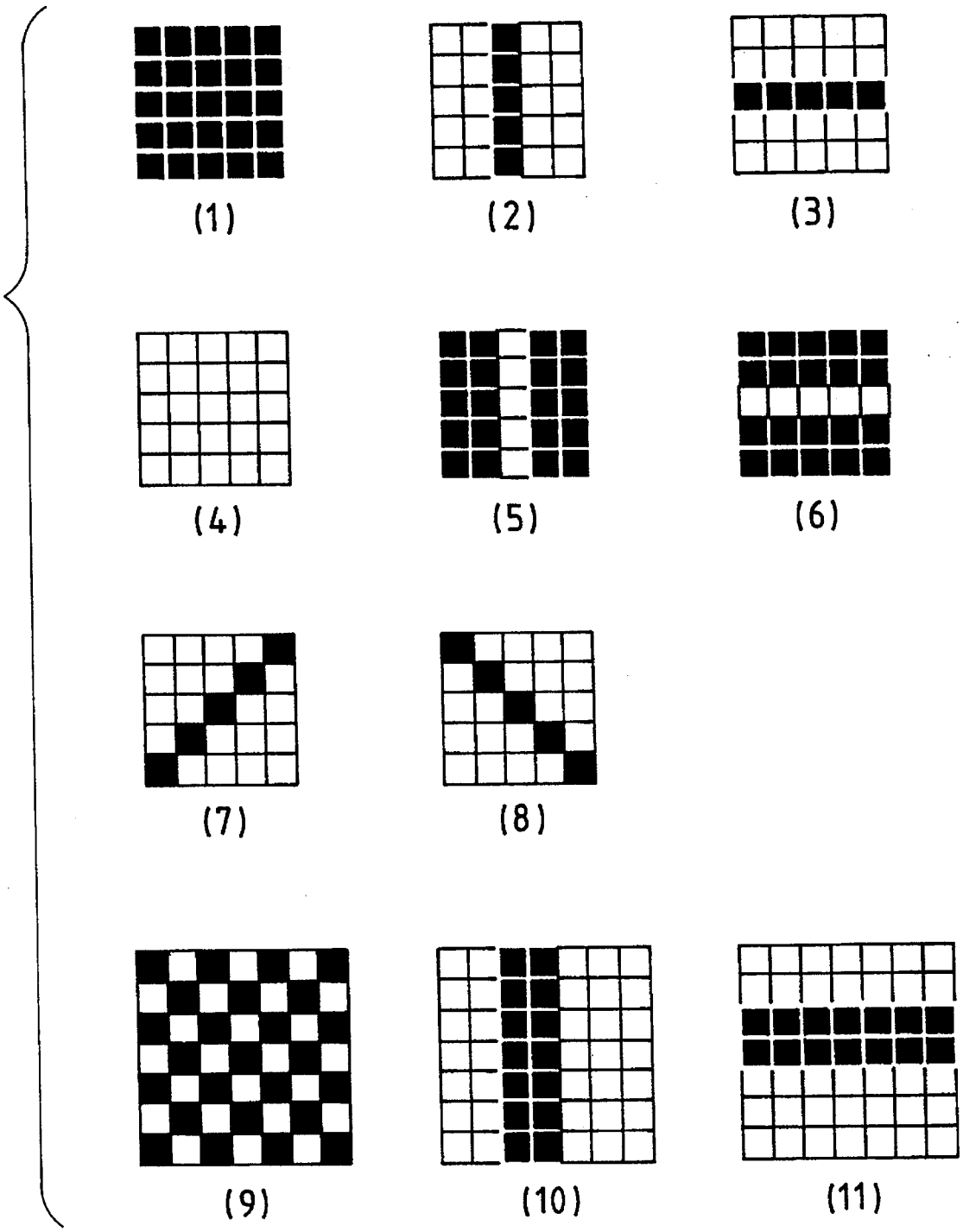
FIG. 4 illustrates examples of standard pattern templates of the present invention.
Figure 5:
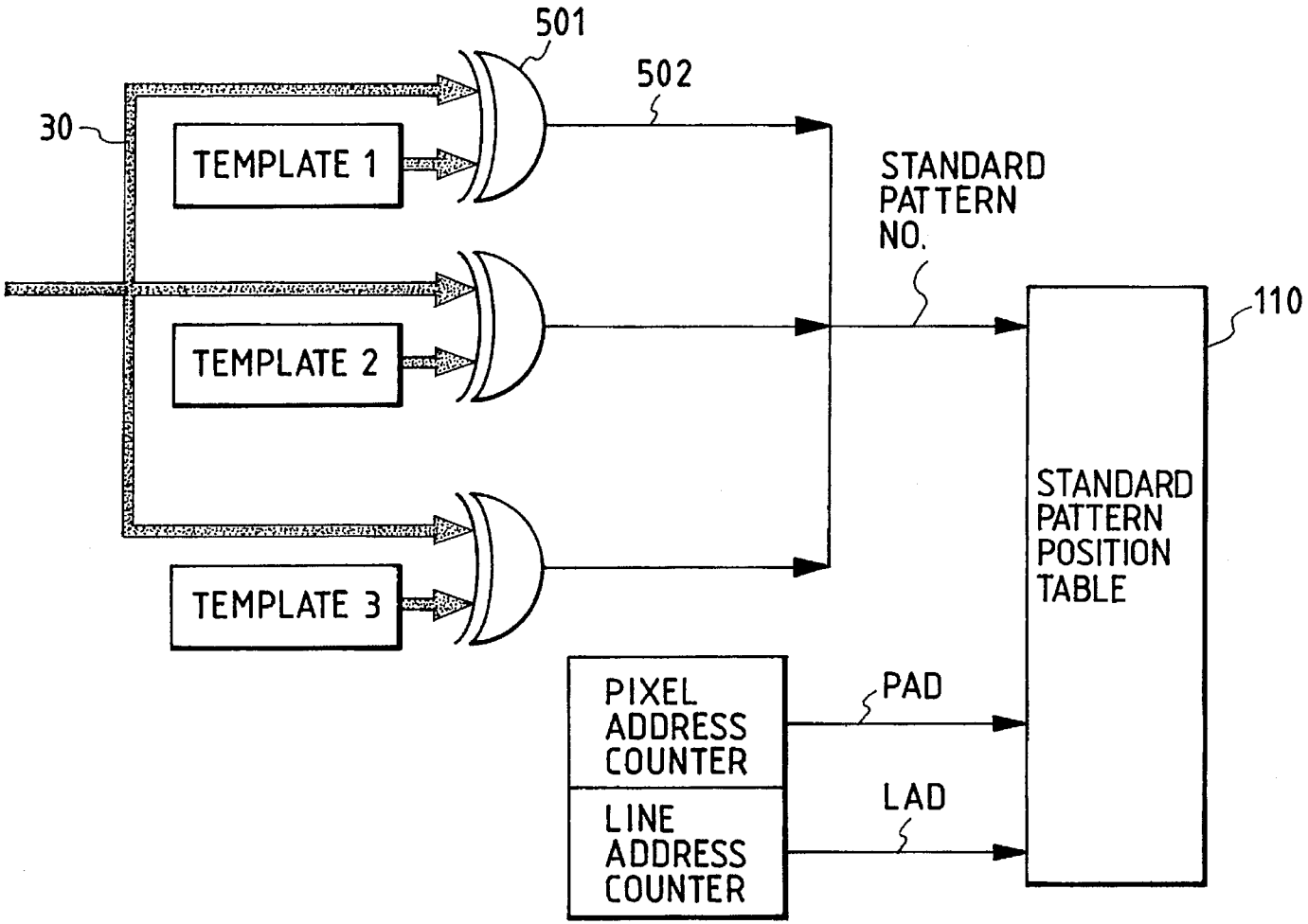
FIG. 5 is a block diagram illustrating a template matching circuit of the present invention.

FIGS. 2 to 6 detailed configurations and principles of operation of the standard pattern position detecting means 109. The standard pattern position detecting means 109 is configured as shown in FIGS. 2 and 5. The principles of operation is an application of a template matching technique of the usual pattern recognition technology.

FIG. 2 depicts a circuit diagram illustrating a buffer memory of the standard pattern position detecting means 109. The buffer memory stores several lines of the input image signal 107 temporarily to obtain all the pixel data (that will be describe later) of the local image in a lump. In general, the laser printer generates a horizontal synch signal 201 for each line to make horizontal synchronization of the image to record. The generated horizontal synch signal 201 is connected with the reset pin, RES, of a pixel address counter 205 to clear an image address PAD to zero. The pixel address counter 205 is connected with four line memories 202 for four lines. An pixel sync signal 203 is obtained for each pixel and is synchronized with the input image signal 107. The pixel sync signal 203 is connected with the clock pin, CLK, of the pixel address counter 205 and with a clock pin (not shown) of 25 latch circuits 204 of D-type flip flops. The pixel sync signal 203 is used as a timing signal for the latches at the time of counting a pixel address. The input image signal 107, as shown in the figure, is fed to the line memories 202 and the latch circuits 204 for each pixel. The line memories 202 receive pixel addresses PAD from the pixel address counter 205 and delays the input image signal 107 by just one line before feeding the input image signal 107. The set of line memories 202 having the features of the pixel address counter 205 built therein, for example, IC memory HM63021, is available on the market.

If the input image signal 107 is recorded by the laser printer, as shown in FIG. 3, it is ordinarily fed for every line from top left to right. The 25 latches 204 feed out signals A1 to A5, B1 to B5, C1 to C5, D1 to D5, and E1 to E5. The output signals, as shown in FIG. 3, are pixel data of a part (called the local image 301 here) of the input image. The pixel data of the local image 301 are sequentially scrolled over the entire input image one pixel by one pixel from top left to right as with the input image signal 107. This embodiment has size of the local image 301 made of 5 pixels by 5 pixels for simplicity of description. The size is ordinarily made larger than pixels of 9 by 9. A smaller local image 301 limits the number of the templates for the standard patterns that will be described later. The size of the local image 301 can be easily enlarged when the number of the line memories 202 is increased. The aspect ratio of the local image 301 also can be easily varied when the number of the line memories 202 is increased.

Patterns (1) to (3) in FIG. 4 show examples of the templates for the standard patterns of the first embodiment that are compared with the local image 301. In the patterns, the black pixels correspond to bit 1 of the input image signal 107 and the white pixels correspond to bit 0 of the input image signal 107. Pattern (1) depicts a solid black image; pattern (2) is a single vertical black line image; and pattern (3) is a single horizontal black line image. Patterns (4) to (6) in the figure, inversion images of the patterns (1) to (3), also show examples of the templates for the standard patterns of the first embodiment which are compared with the local image 301. Pattern (4) depicts a background image (solid white image); pattern (5) is a single vertical white line image; and pattern (6) is a single horizontal white line image. These patterns, (4) to (6), are omitted from the description of the embodiment because they can be treated in the same way as the patterns (1) to (3), although they are important standard template patterns that can control the image quality. Patterns (7) and (8) in the figure are single 45-degree slanted black lines that are used to measure respective single points of an output image with respective single sensors. The patterns (7) and (8) will be described in detail later.

The size of the template of 5 pixels by 5 pixels serves only to illustrate such simple standard patterns. However, as an example, the size of the template of pixels of 7 by 7 can serve to form more complicated figures, such as shown in patterns (9) to (11) in FIG. 4. Pattern (9) is a halftone image, pattern (10) is a vertical two-line image, and pattern (11) is a horizontal two-line image. With the size of the template made larger as described above, any desired complicated standard patterns can be defined. The simple and complicated template data are formed by a logic circuit 501 and an ROM (read-only memory) in a template matching circuit, respectively.

FIG. 5 depicts a block diagram illustrating an example of the template matching circuit formed in the standard pattern position detecting means 109. The logic circuit 501 compares 25 pixels of the local image 301 with the data of templates (1) to (3) for each pixel. If they are identical, the logic circuit 501 generates an coincidence signal 502. For template (1), as an example, all the pixels are black, or bit 1. The 25 pixels data of the local image 301 therefore are all exclusive-ORed with bit 1. If the pixels data are all identical, or bit 1, the logic circuit 501 generates the coincidence signal 502. It should be noted that the ROM, for example, IC memory HN624016, can be used in place of the logic circuit 501. Also, the logic circuit 501 and ROM can be used together.

Assuming all the pixel data of the local image 301 coincide with template (1), the generated coincidence signal 502 is transformed to data referred to as the standard pattern No. 3 before being stored in the standard pattern position table 110. At the same time, a pixel address PAD and a line address LAD of a pixel C4 at a center of the local image 301 also are stored in the standard pattern position table 110. The pixel address PAD and line address LAD indicate on what descending line and at what number the pixel C4 at the center of the local image 301 positions. The pixel address PAD can be easily obtained by the pixel address counter 205 shown in FIG. 2. The line address LAD also can be easily obtained by way of counting the pixel sync signal 203 by a line address counter. It is assumed here that a printing page is n and the pixel C4 at the center of the local image 301 is in line y1 and at position x1. If the standard pattern No. 1 in FIG. 4 is detected to coincide on the assumption, the standard pattern position table 110 is created as shown a by pattern order 1 in Table 1 below. The standard pattern position table 110 is a memory for successively storing results of the standard position detection of one page. The stored contents are examined afterward by the output image density measuring means 111 and the image quality judging means 112 as shown in FIG. 1.

TABLE 1

| | | Position of local image 301 | | Standard |
|---|---|---|---|---|
| Page No. | Pattern order | Pixel address PAD | Line address LAD | Pattern No. in FIG. 4 |
| n | 1 | x1 | y1 | (1) |
| | 2 | x2 | y2 | (2) |
| | 3 | x3 | y3 | (3) |
| | 4 | x4 | y4 | (4) |
| | 5 | x5 | y5 | (5) |

If the local images 301 that are standard patterns in the input image are concentrated in virtually the same position, the standard pattern position table 110 is created so that the local images 301 can be distributed with appropriate intervals in the input image. The table in first embodiment has the position of the standard pattern detected by the microcomputer 505 lastly stored therein. The table does not have another standard pattern unless the pattern is separated to some distance from the other stored standard patterns in the main scanning or sub-scanning direction. If detection of the positions of the standard patterns of one page ends, the standard pattern position table 110 is fed out to the output image density measuring means 111 and the image quality judging means 112, or the output image density measuring means 111 and the image quality judging means 112 are made to examine the standard pattern position table 110.

Returning to FIG. 1, the configuration of the first embodiment of the present invention is further described below. The output image density measuring means 111 in the first embodiment measures on the recording paper 114 after the fixing arrangement 106. It takes a time of around one page for the image of page n exposed by the exposing optical system 103 to come from development, transference, and fixing to the position of the output image density measuring means 111. When beginning of the image on page n reaches the position of the output image density measuring means 111, and before the standard pattern position table 110 in FIG. 5 has been completed the standard pattern position detecting means 109 has already ended pattern matching of the entire page n. The output image density measuring means 111 retrieves an output image area corresponging to the local image 301 from among the output image 108 according to the standard pattern position data of the standard pattern position table 110. The output image density measuring means 111 then feeds the image density data of the area out to the image quality judging means 112 as a local image read signal 116.

Figure 6:
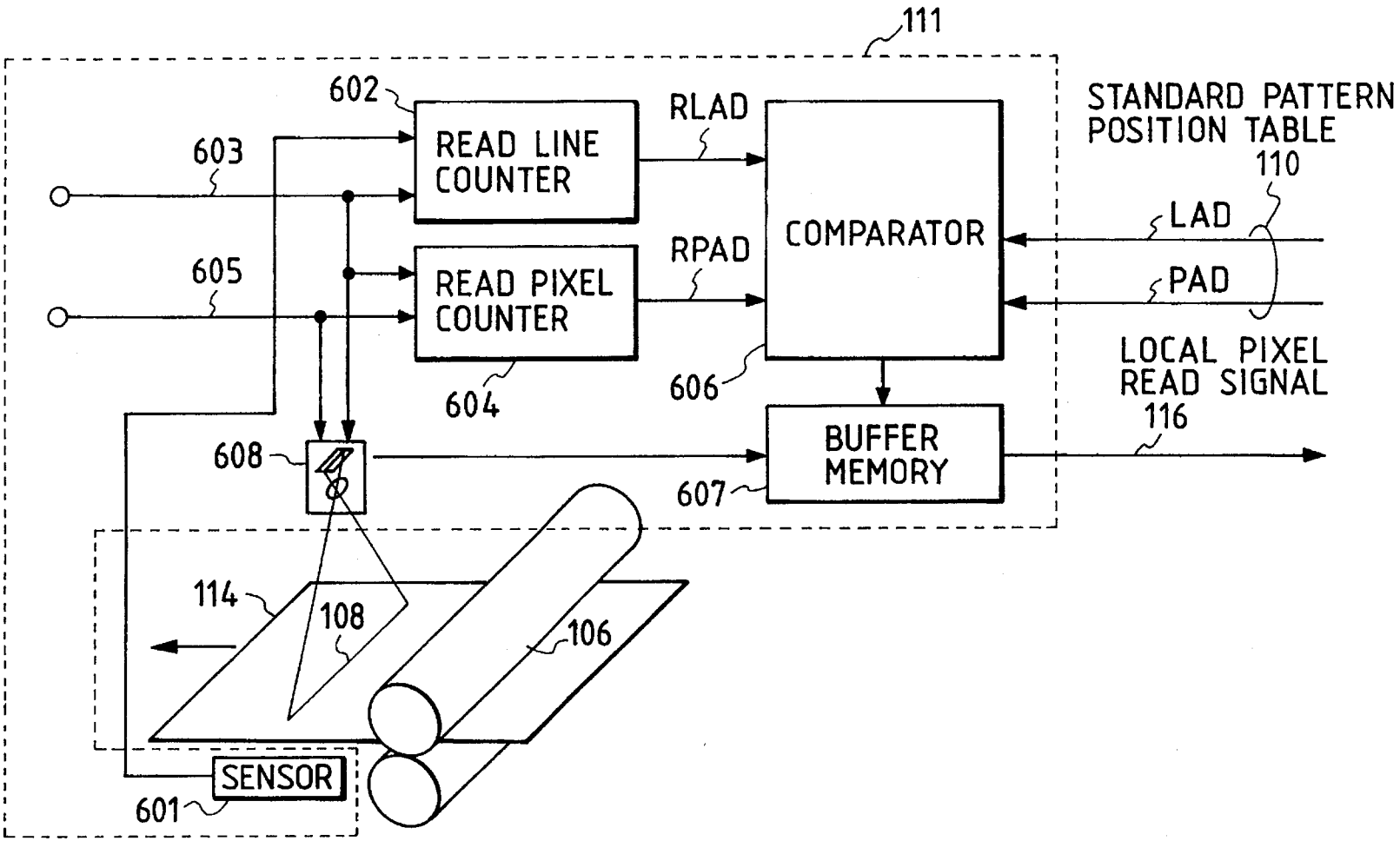
FIG. 6 is a block diagram, partly perspective, illustrating configuration of an output image density measuring means of the present invention.

In turn, the following describes the output image density measuring means 111 shown in FIG. 1. The output image density measuring means 111 measures the image density of a necessary part of the output image 108 recorded on the recording paper 114 with use of an optical sensor. The output image density measuring means 111 then feeds the measured result to the image quality judging means 112 as the local image read signal 116. FIG. 6 depicts a block diagram, partly perspective, illustrating the output image density measuring means 111 in detail. A recording paper head detecting sensor 601 is formed of a light source and a light receiver. The recording paper head detecting sensor 601 detects the beginning of the recording paper 114 of page n fed out of the fixing arrangement 106. A read line counter 602 then is cleared. The read line counter 602 counts a read line sync signal 603 originating from a reference clock of a crystal oscillator or the like to obtain a read line address RLAD. At the same time, the read line sync signal 603 clears a read pixel counter 604. The read pixel counter 604 counts a read pixel sync signal 605 originating from the reference clock of the crystal oscillator or the like to obtain a read pixel address RPAD. A comparator 606 compares the RLAD and RPAD with the LAD and PAD of the standard pattern position table 110 made by the standard pattern position detecting means 109, respectively. If they are identical, then the comparator 606 makes a buffer memory 607 read the density data of the area of the output image 108 corresponding to the local image 301 from a image density measuring device 608. It is assumed here that as an example, the image density measuring device 608 is a CCD linear sensor 608 of a known micro-optical system as shown in the figure. The CCD sensor 608 has the read line sync signal 603 and the read pixel sync signal 605 input therein. The CCD sensor 608 has a circuit (not shown) to read the image density of the output image 108 at a level of 8-bit 256 level while synchronizing with those synchronous signals. The reading width may be of the entire output image or parts of the output image. For reading the parts, only the local image 301 present at readable positions should be written in the standard pattern position table 110 shown in Table 1 when the standard pattern position table 110 is created. Reading resolution of the CCD sensor 608 is preferably higher than that of the image recording apparatus. The first embodiment shows an example of reading at 1,200 dots per inch while the laser printer reads at 400 dots per inch. The pixel of the local image read signal 116 therefore is called the micro-pixel here since the size is made one-third of the pixel of the input image signal 107.

Figure 7:
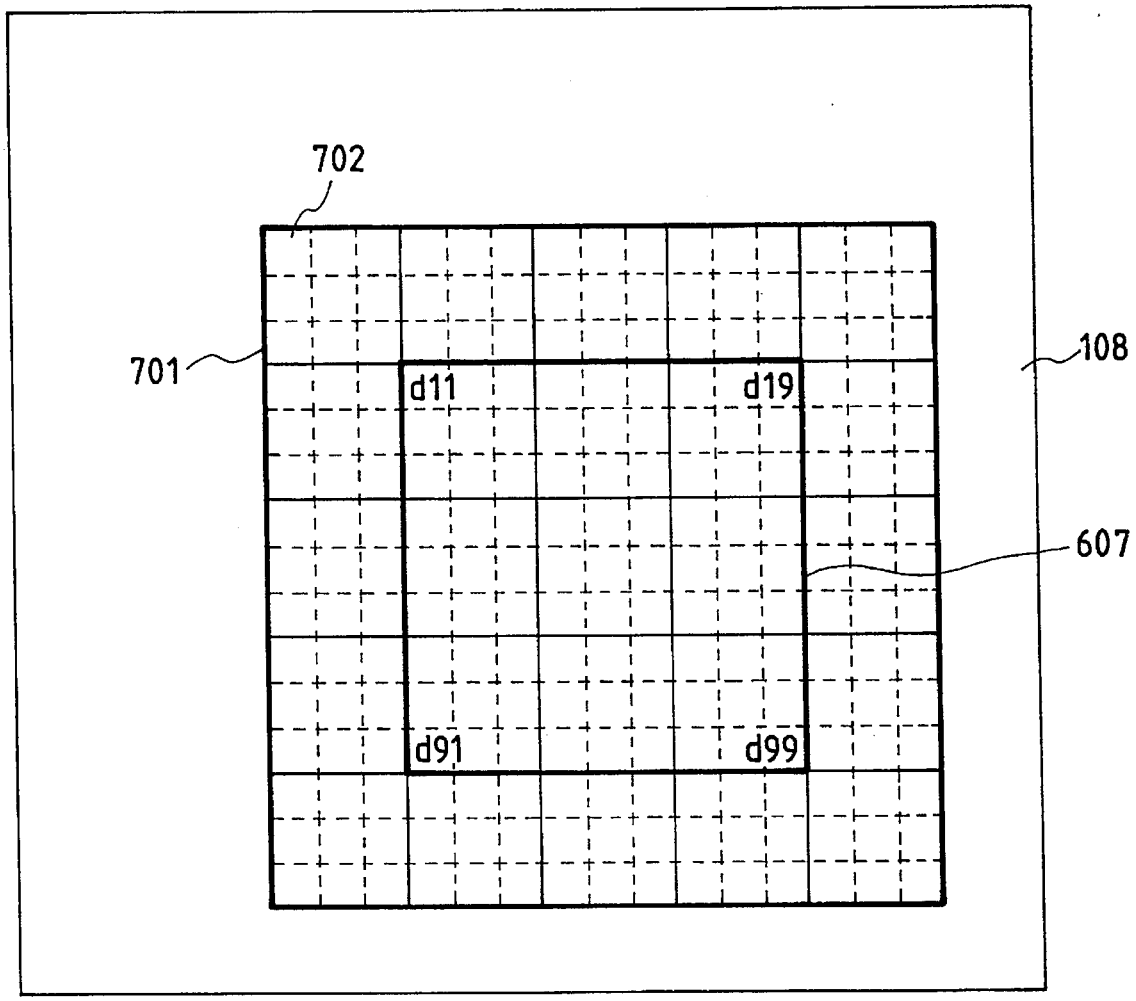
FIG. 7 is a plan view illustrating a local image read signal of the present invention.
Figure 15:
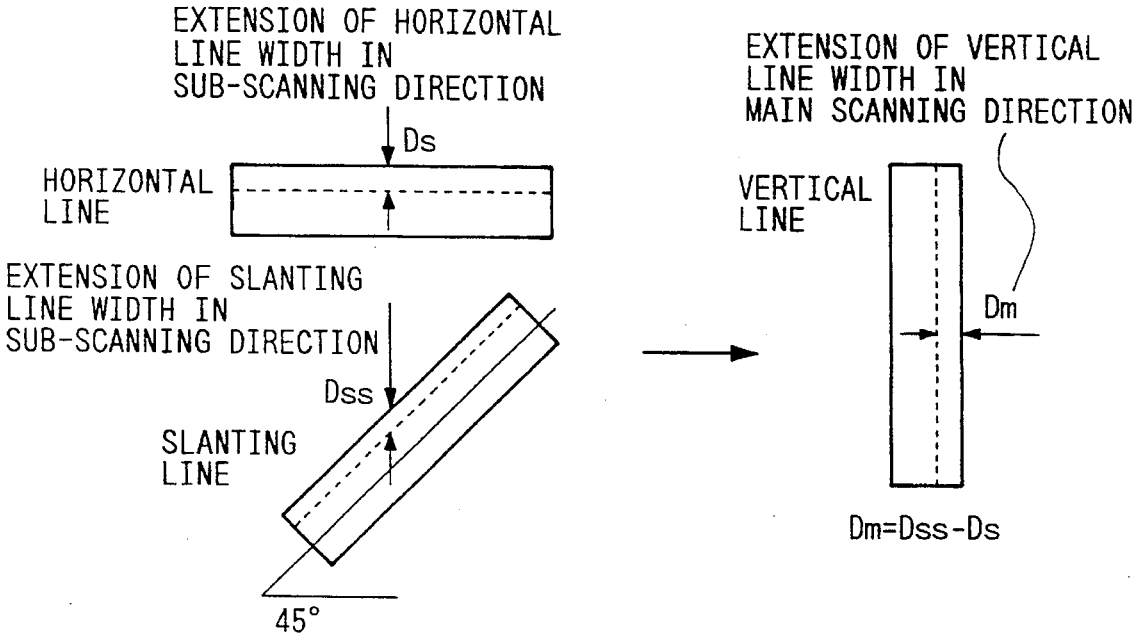
FIG. 15 is a set of scanning views illustrating a slanting line using method for line width of the present invention.

FIG. 7 depicts a plan view illustrating the local image read signal 116. The size of the local image 301 is 5 pixels by 5 pixels. The minute pixels 702 of 15 by 15 can be obtained at the resolution of 1,200 dots per inch if an output image area 701 corresponding to the local image 301 is read at a resolution three times that resolution by the output image density measuring means 111. It should now be noted that the previous image recording apparatuses unavoidably involve some deviation of a position of the output image area 701 corresponding to the local image 301 from a position of the local image 301 recorded on the output image 108 on the paper on the input image signal 107. The first embodiment measures only the 3 pixels by 3 pixels in the local image 301 of the 5 pixels by 5 pixels not to make erroneous determination the image quality judging means 112 that will be described later, even if the position is deviated around one pixel at maximum in the main scanning and sub-scanning directions. Only 81 density data of d11 to d99 of the minute pixels 702 in FIG. 7, therefore, are read in the buffer memory 607 before being fed out to the image quality judging means 112 as the local image read signal 116 as shown in FIG. 1. The image density measuring device 608 in the first embodiment is made of a CCD linear sensor of the micro-optical system. The image density measuring device 608 may be alternatively made up of contact CCD linear sensor or of laser beam scanned by a polygonal mirror. Also, the image density measuring device 608 may be still alternatively made up in a way that a single laser beam or LED is used as a light source and a single sensor having a photodetector used to receive a reflected light is movably placed in the main scanning direction. The single sensor may be moved to a position at which the image density is to be read to measure. If the single sensor cannot be moved, it should be set so that it can measure a left side of the image that a user can record at a high frequency. In this case, since only the line widths in the sub-scanning direction can be measured, the vertical line widths, including standard patterns (2), (5), and (10) in FIG. 4, cannot be measured directly. However, as shown in FIG. 15, standard patterns (2), (5), and (10) can be estimated in the following way. Measurement should be made on an extension Ds of the horizontal line width in the sub-scanning direction. Measurement also should be made on an extension Dss of the line width, shown by standard pattern (7) or (8) in FIG. 4, slanted 45 degrees in subscanning direction to the horizontal direction. An extension Dm of the vertical line width in the main scanning direction should be calculated in terms of the measured results by Dm=Dss−Ds. The extension Dm alternatively should be obtained by experiment.

Returning to FIG. 1, the configuration of the first embodiment is further more described below. The image quality judging means 112 judges the image qualities of the standard patterns on the basis of the standard pattern position table 110 from the standard pattern position detecting means 109 and the local image read signal 116 from the output image density measuring means 111. Image quality judgement results 115 are fed to a process controlling means 113.

Table 2 shows the results of Table 1 and the local image read signal 116 and the image quality judgement results 115.

TABLE 2

| | | Standard pattern Position | | | Local image | |
|---|---|---|---|---|---|---|
| Page No. | Pattern order | Pixel address PAD | Line address LAD | Standard Pattern No. in FIG. 4 | read signal 113(8 bits/micro-pixel) | Image quality judge result |
| n | 1 | x1 | y1 | (1) | d11, ~ ,d99 | J1 |
| | 2 | x2 | y2 | (1) | d11, ~ ,d99 | J1 |
| | 3 | x3 | y3 | (3) | d11, ~ ,d99 | J3 |
| | 4 | x4 | y4 | (2) | d11, ~ ,d99 | J2 |
| | 5 | x5 | y5 | (3) | d11, ~ ,d99 | J3 |

The first embodiment defines the image quality judgement results 115 as follows.

Standard pattern (1) in FIG. 4: Average image density J1=(d11+d12+, . . . ,+d99)/81.

Standard pattern (2) in FIG. 4: Average line width J2=(J21+J22+, . . . ,+J29)/9, where J2i is a number of dij, dij>T, and j=1 to 9 where T is a threshold value density for determining the line width.

Standard pattern (3) in FIG. 4: Average line width J3=(J31+J32+, . . . ,+J39)/9, where J3j is a number of dij, dij>T, and i=1 to 9 where T is a threshold value density for determining the line width.

In addition, the image quality judgement results 115 may include density unevenness of standard pattern (1) and line center position and density of standard patterns (2) and (3).

As described above, the first embodiment measures only the 3 pixels by 3 pixels in the local image 301 of the 5 pixels by 5. The image quality judging means 112 therefore does not to make erroneous judgement even if the position read by the output image density measuring means 111 deviates one pixel at maximum vertically and horizontally. As an example, standard pattern (1) in FIG. 4 is the solid image of 5 pixels by 5 pixels. The measurement result is the solid image even if the measurement position on the center of 3 pixels by 3 pixels deviates by one pixel at maximum vertically and horizontally. For standard pattern (2) in FIG. 4, also, the measurement can catch the vertical single line even if the measurement position deviates by one pixel at maximum vertically and horizontally. Since the measurement position on the center of 3 pixels by 3 pixels has no other pixels put therein, the above-described judgement procedures can obtain correct line width. For standard pattern (3) in FIG. 4, measurement is made in a similar way.

Returning to FIG. 1, the configuration of the first embodiment is still further described below. The process controlling means 113 changes process parameters of the laser printer on the basis of the image quality judgement result 115 from the image quality judging means 112. The major changeable process parameters include:

Charger 102: Corona wire voltage and current and grid voltage.

Exposing optical system 103: Light intensity amplitude, pulse width, and spot diameter.

Developing arrangement 104: Amount of toner supply and development bias voltages, ac and dc.

Transferring arrangement 105: Corona wire voltages, ac and dc.

Fixing arrangement 106: Roller temperature, speed, and pressure.

In the first embodiment, a printing experiment is made while the above-mentioned process parameters are changed in variable ranges in advance. The image quality judgement results 115 (J1, J2, and J3) may deviate from their desired values (J1 ref, J2 ref, and J3 ref). To return them to the desired values (J1 ref, J2 ref, and J3 ref), the microcomputer has a table created in a memory thereof in advance. The table has set values for the process parameters. In the first embodiment, as an example, the table is stored in such a form of control determinant as Eq. 1 below. The process parameters are sequentially changed on the basis of the image quality judgement results 115 and desired image quality values.

$$\begin{pmatrix} p1' \\ p2' \\ pn' \end{pmatrix} - \begin{pmatrix} p1 \\ p2 \\ pn \end{pmatrix} = \begin{pmatrix} a11 & a12 & a13 \\ a21 & a22 & a23 \\ an1 & an2 & an3 \end{pmatrix} \left( \begin{pmatrix} J1 \\ J2 \\ J3 \end{pmatrix} - \begin{pmatrix} J1\text{ref} \\ J2\text{ref} \\ J3\text{ref} \end{pmatrix} \right) \quad (1)$$

where p1', p2' through pn' are process parameter vectors before change; p1, p2 through pn are process parameter vectors after change; all through an3 are the control determinant; J1, J2, and J3 are image quality judgement result vectors; and J1 ref, J2 ref, and J3 ref are the desired image quality value vectors.

If for the sequential change, a line memory and a page memory are provided to store the process parameters in synchronization with the position of the photosensitizing drum 101, the process parameters can be controlled independently with the position of the photosensitizing drum 101 changing. For the control in the main scanning direction, the process parameters only for the exposing optical system 103 can be changed.

The first embodiment measures the final image after fixing. This allows the image quality control for every standard pattern and for every recording position on the photosensitizing drum 101. The resulted output image quality can be made stable. The image quality measurement by the above-described technique for forming the exclusive standard patterns may be made at the time of power-on or after having printed a certain number of sheets. During printing, the operation of the embodiment is always performed. In combination of those operations, an image pattern that a user prints rarely can be accurately image-corrected for long intervals by the technique of the first embodiment. An image pattern that the user prints frequently can be always finely adjusted by the technique of the first embodiment. Also, failure can be detected. The first embodiment makes it possible to construct such a sophisticated control system.

If the standard pattern position detecting means 109 cannot find any of the registered standard patterns, an image density detecting means (not shown) detects the entire image. The standard pattern position detecting means 109 extracts a pattern that is most often used. The pattern is temporarily registered as a temporal standard pattern. The temporal registration state is indicated by an indicator if the indicator is added on the image recording apparatus. The indication asks the user whether the temporal registration should be regularly registered or not. To do so, the user should make a regular registration direction. (The regular registration direction can be made with a registration setting button on a keyboard or similar input arrangement if it is provided for the image recording apparatus.) The newly registered regular pattern can be used from the next detection.

If the image quality cannot be improved to a certain state even with the process parameters changed to control on the basis of results of the image quality measurement, there should be added a service life judging means that can judge that a part of the process ends life. The service life judging means can early detect deterioration or shortage of the developer or deterioration of the photosensitizer before informing to the user through a signaling means. This can prevent useless printing, thereby increasing the efficiency of use.

Figure 14:
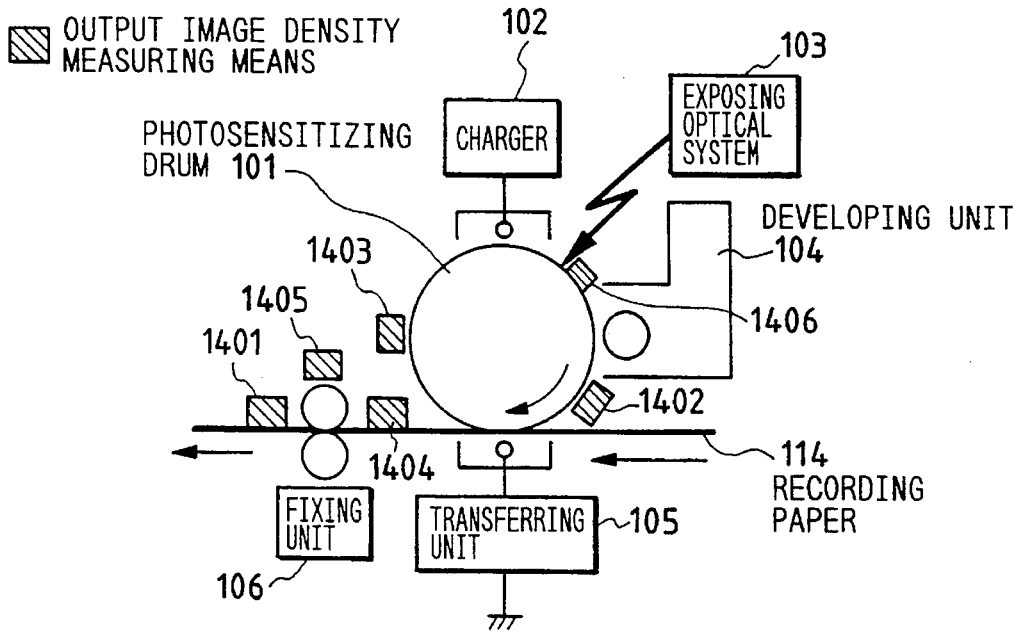
FIG. 14 is a block diagram illustrating configuration of another image density measuring means of the present invention.

The image density measuring device 608 can be placed at other several positions. FIG. 14 depicts a block diagram illustrating configuration of another image density measuring means. The image density measuring means 608 are placed on the recording paper 114 (1401) right behind the fixing arrangement 106 and on the photosensitizing drum 101 (1402) right behind the developing arrangement 104. In addition, the image density measuring means may be placed on the photosensitizing drum 101 (1403) and the recording paper 114 (1404) right behind the transferring arrangement 105 and on the a heat roller (1405) right behind the fixing arrangement 106. The image density measuring device 608 can be replaced by a surface potential measuring devices of high resolution. The devices should be placed on the photosensitizing drum 101 (1402) and (1406). The surface potential measuring devices are defective in low resolution. An inventors' experiment showed that the resolution was around 100 {SYMBOL 109 \f "Symbol"}m. The devices are available for the solid black and white and halftone standard patterns. They however cannot be used for thin-line patterns.

Figure 8:
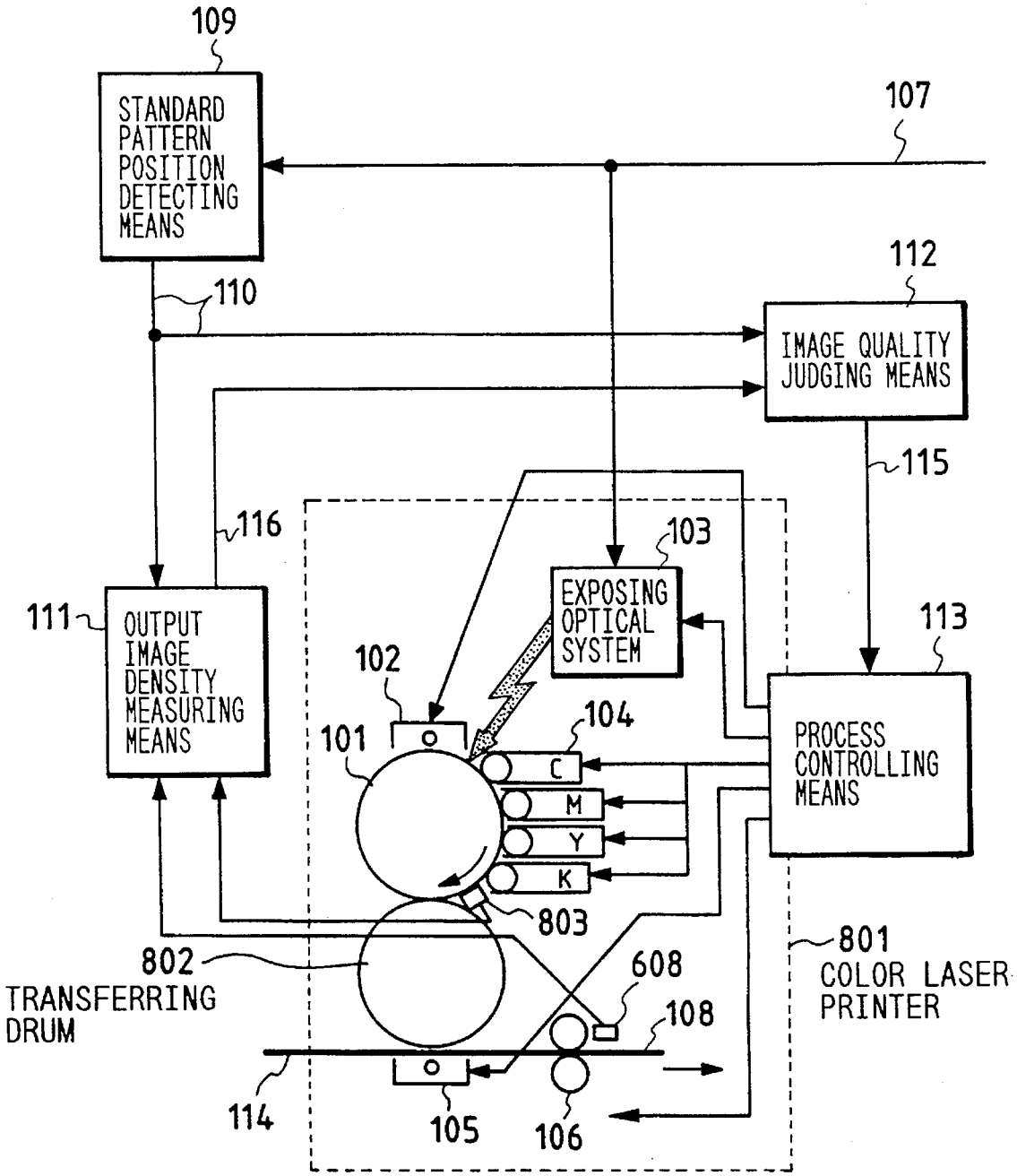
FIG. 8 is a block diagram illustrating configuration of a second embodiment of the present invention.

The following describes in detail other embodiments according to the present invention by reference to FIGS. 8 to 11 on the accompanying drawings. FIG. 8 depicts a block diagram illustrating configuration of a second embodiment. The second embodiment uses a known color laser printer 801 as an example of the image recording apparatus. The color laser printer 801 differs chiefly from the monochrome laser printer shown in FIG. 1 in that there are four developing arrangements 104 for cyan 104c, for magenta 104m, for yellow 104y, and for black 104k. and There is a transferrer 802. An input image signal 107 has usually four color signals of cyan C, magenta M, yellow Y, and black K sent successively for four monochrome pages. The color laser printer 801 forms color toner images on a photosensitizing drum 101 while switching over developing arrangements 104 successively on the basis of the color signals. The color laser printer 801 then registers the color images on the transferrer 802 without position deviation. After the four color images are registered, a transfer process 105 transfers the four color images onto recording paper 114 at a time. Finally, a fixing process 106 fixes the images to obtain a color output image 108.

As for a standard pattern position detecting means 109 and an output image density measuring means 111, they perform the same process as in the first embodiment four times for the four colors. Image quality judgement results 115 by an image quality judging means 112 are defined as follows.

Standard pattern (1) in FIG. 4: Average image density J1=(d11+d12+, . . . ,+d99)/81.

Standard pattern (2) in FIG. 4: Average line width J2=(J21+J22+, . . . ,+J29)/9, where J2i is a number of dij, dij>Tk, and j=1 to 9 where Tk is a threshold value density for determining the line width, being different for each color of measurement, and k is c (cyan), m (magenta), or y (yellow).

Standard pattern (3) in FIG. 4: Average line width J3=(J31+J32+, . . . ,+J39)/9, where J3j is a number of dij, dij>Tk, and i=1 to 9 where Tk is a threshold value density for determining the line width, being different for each color of measurement, and k is c (cyan), m (magenta), or y (yellow).

A process controlling means 113 has memories for storing process parameters for the colors for an exposing optical system 103 and the developing arrangement 104. The process parameters can be changed for each color.

It should be noted in the second embodiment that as shown in the figure, for an output image density measuring means 111, an image density measuring device 803 is placed on the photosensitizing drum 101 right behind the developing arrangement 104 in addition to an image density measuring device 608 placed right behind the fixing arrangement 106 shown in the preceding first embodiment. The reason is that since the transferrer 802 and the recording paper 114 have the color toner images registered thereon, the image quality measuring technique for each single color described in the first embodiment cannot be used. The measurement can be made for each color on the photosensitizing drum 101 right behind the developing arrangement 104. However, the black toner image cannot be measured since a surface of the photosensitizing drum 101 is low in reflection factor. In this case, the black toner image should be measured by the image density measuring device 608 right behind the fixing arrangement 106 when the single black is printed. Since printing in the single black is frequently made and even the color laser printer 801 transfers it to the recording paper 114 by turning the transferrer 802 only once, the single black printing can be detected.

The second embodiment can control the image quality of the fullcolor printer. Moreover, the second embodiment can make use of a monochrome sensor for the image density measuring device 803 since the recording order is known in advance. This is economic.

Figure 9:
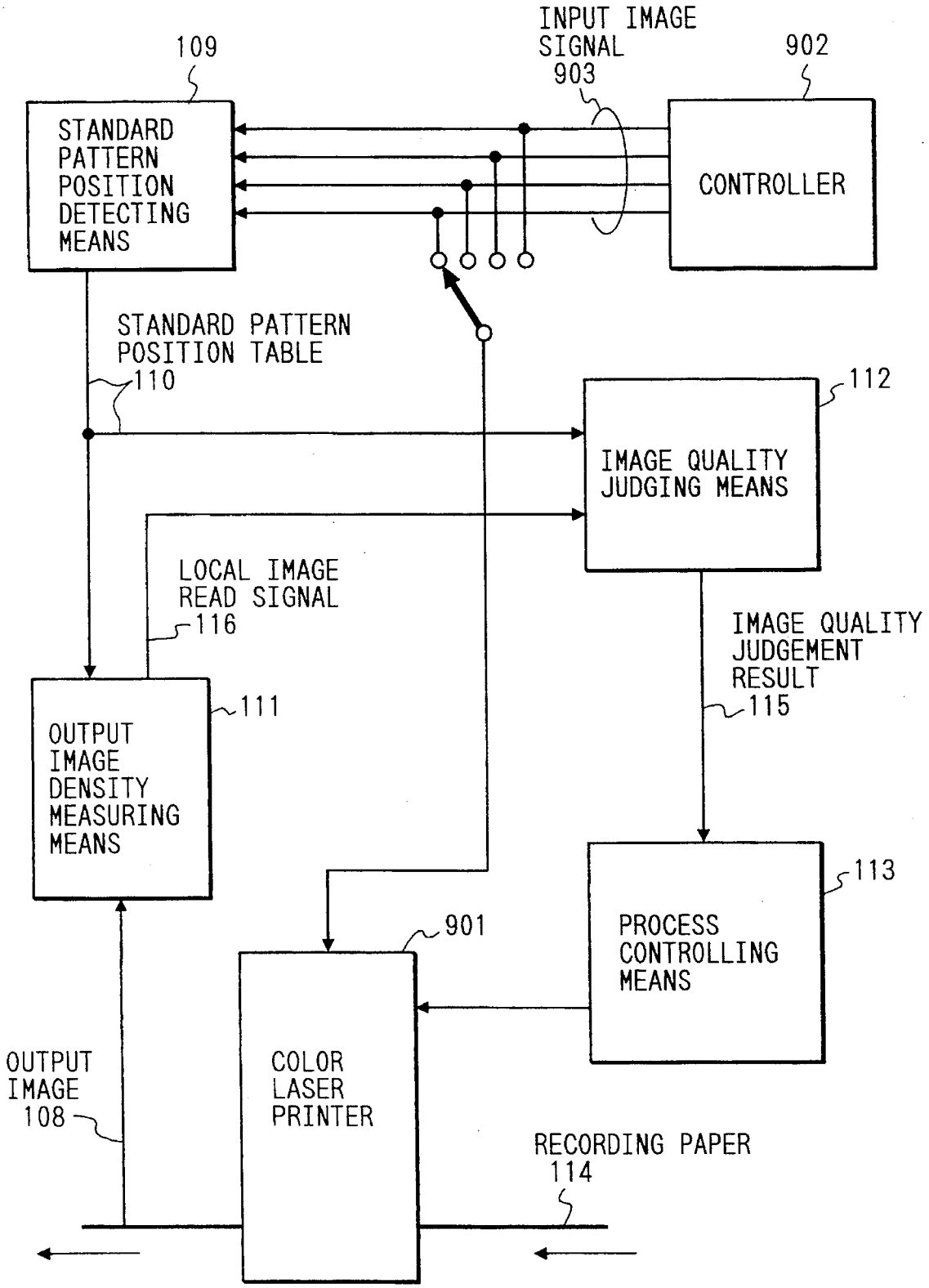
FIG. 9 is a block diagram view illustrating configuration of a third embodiment of the present invention.
Figure 10:
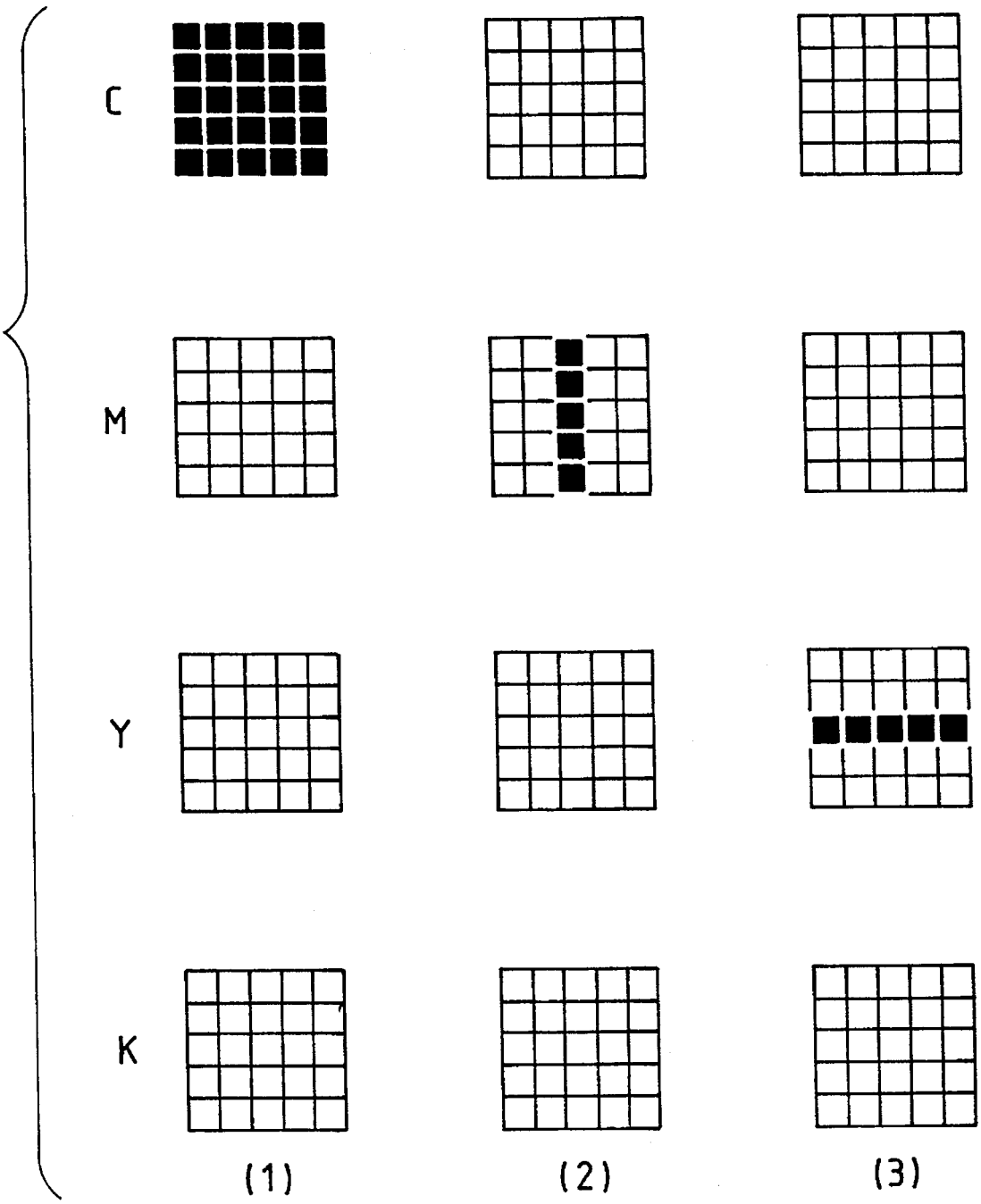
FIG. 10 illustrates examples of standard pattern templates of the present invention.
Figure 11:
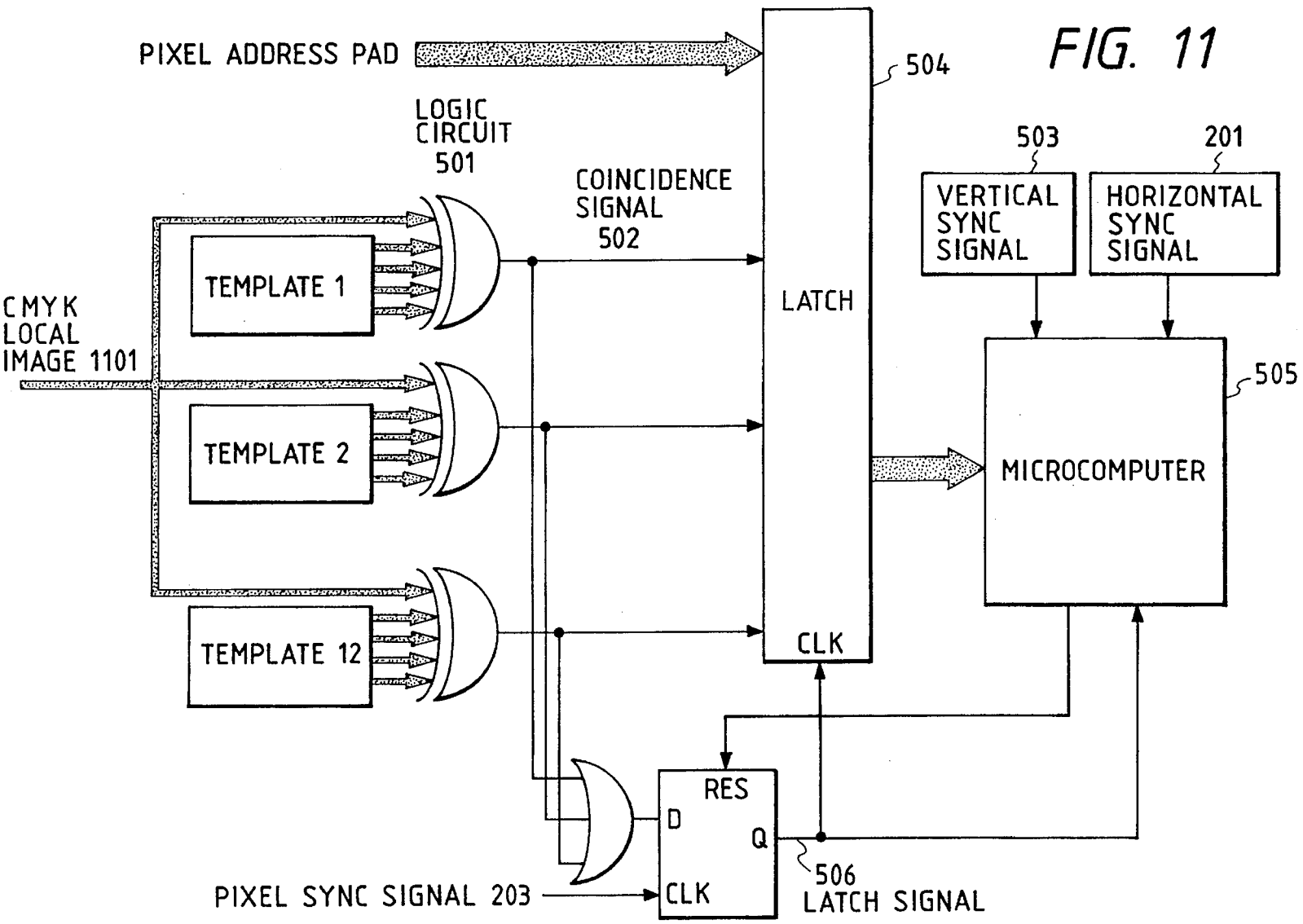
FIG. 11 is a block diagram illustrating a template matching circuit of the present invention.

The following describes in detail a third embodiment according to the present invention by reference to FIG. 9. FIG. 9 depicts a block diagram view illustrating configuration of the third embodiment. The third embodiment uses a known color laser printer 901 as an example of the image recording apparatus as in FIG. 8. The output image density measuring means 111 in the third embodiment is not provided with the image density measuring device 803 on the surface of the photosensitizing drum 101 shown for FIG. 8 in the second embodiment. An image density measuring device 608 right behind a fixing arrangement 106 in the third embodiment measures the local images corresponding to the standard patterns of all colors. The fixing arrangement 106 therefore must measure the image having the color toners already mixed. An input image signal 107 fed from a controller 902, as described previously, has four color signals of cyan C, magenta M, yellow Y, and black K sent successively for four monochrome pages. The third embodiment has four image signal lines 903 led from the controller 902 to the color laser printer 901 and to the standard pattern position detecting means 109 in place of the previous single image signal line. The third embodiment does not operate in the way that only the first color signal, for example, cyan C input image signal 107, is sent to the color laser printer 901 and to the standard pattern position detecting means 109 while the first color is recorded. Instead, all the four image signals 903 of the four colors, including cyan C, magenta M, yellow Y, and black K, are sent to them at the same time. An exposing optical system 103 inside the input image signal 903 selects one of the color image signals to record before making exposure. The standard pattern position detecting means 109 therefore is devised to treat the four color image signals at the same time. The standard pattern position detecting means 109 has four buffer memories for cyan C, magenta M, yellow Y, and black K instead of the one in FIG. 2. The local image 301 shown in FIG. 3 is input to a template matching circuit shown in FIG. 11 as a CMYK local image 1101 having the CMYK data. There are provided also standard pattern templates for the four colors accordingly. The template matching circuit in FIG. 11 has 12 standard pattern templates in total, three forms (solid image, single vertical line, and single horizontal line) by four colors (C, M, Y, and K). FIG. 10 depicts patterns illustrating examples of the standard pattern templates. FIG. 10 (1) shows a C solid image; (2) is a M single vertical line; and (3) is a Y single horizontal line. An object of the third embodiment is to control the image qualities of the basic standard patterns, the standard patterns are all single colors. It is easy to create also standard patterns of mixed colors, such as red R, green G, and blue B, only by changing the templates. This allows detecting the standard pattern containing color data from the full-color input image 903. As a result, a standard pattern position table 110 containing the color data can be obtained.

The third embodiment can make accurate and substantial measurements because it measures a realistic fixed output image. The third embodiment also can control the image quality of the mixed images, such as RGB, and the single colors of CMYK as well.

Figure 16:
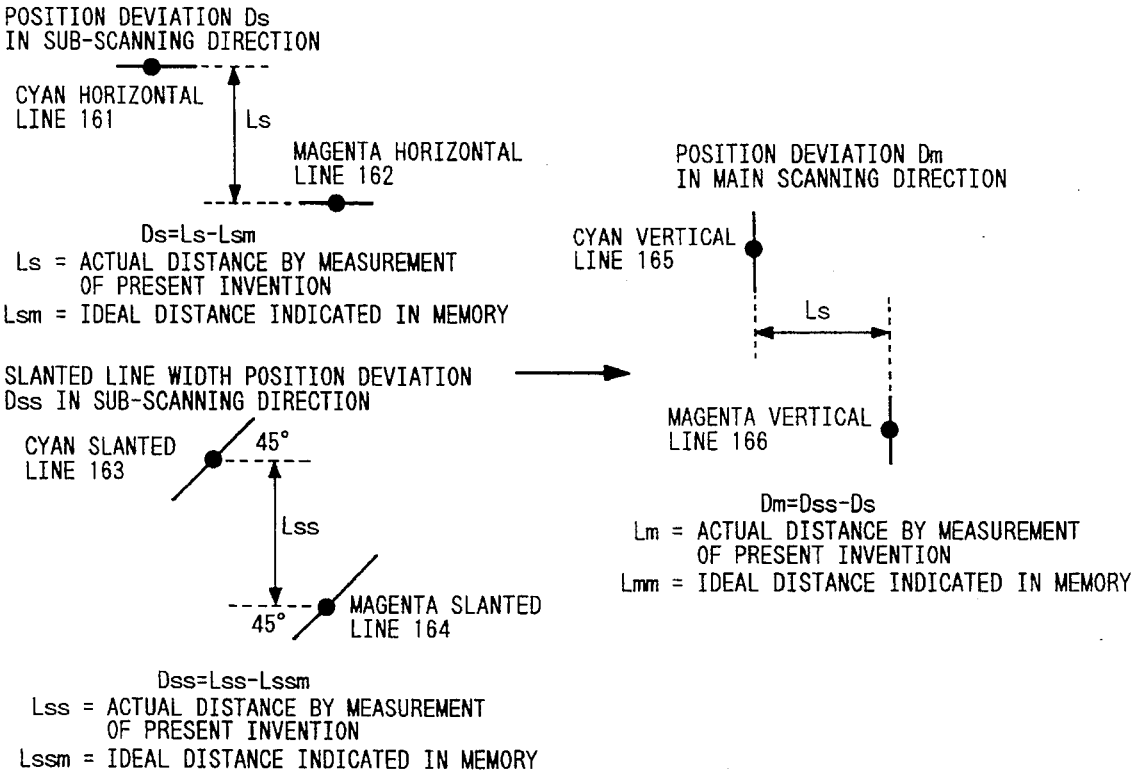
FIG. 16 is a set of diagrams illustrating a slanting line using method for position deviation of the present invention.

Also, position deviations of the image colors can be eliminated as discussed below. The third embodiment can detect the standard patterns of monochrome single vertical lines and single horizontal lines of the colors (CMYK) from the full-color input image 903. The output image density measuring means 111 measures the fixed full-color input image 903. An image quality judging means 112 judges line center positions of the monochrome single vertical lines and single horizontal lines of the colors before measuring the vertical and horizontal position deviations of the color images by reference to the center positions. The exposure process 103 is made to adjust the exposure positions of the color images. Thus, the position deviations of the image colors can be eliminated. FIG. 16 depicts diagrams illustrating an example of the elimination of the position deviations. First, the standard pattern position detecting means 109 detects the center positions of the cyan horizontal line 161 and the magenta horizontal line 162 in the same image. An ideal distance Lsm is calculated from difference of line addresses LAD. Second, the output image density measuring means 111 detects an actual distance Ls. The image quality judging means 112 calculates a position deviation Ds in the sub-scanning direction equal to the difference, (Ls–Lsm). Similarly, a position deviation Dm in the main scanning direction is calculated in terms of the center positions of the cyan vertical line 165 and the magenta vertical line 166 in the same image. The process controlling means 113 directs a controller to adjust read positions of the controller 902 of each color in the main scanning direction and the sub-scanning direction. This makes it possible to always monitor and adjust of the position deviations of the colors. The image density measuring device 608 in the third embodiment is of high resolution and low cost because it may be monochrome. The image density measuring device 608 may be alternatively made up of in a way that a single laser beam or LED is used as a light source and a single sensor having a photo-detector used to receive a reflected light is movably placed in the main scanning direction. The single sensor may be moved to a position at which the image density is to be measured. If the single sensor cannot be moved, it should be set to measure the left side of the image that a user can record frequently. In this case, because only the position deviation in the sub-scanning direction can be measured, the position deviation in the main scanning direction cannot be measured directly. However, as shown in FIG. 16, the position deviation in the main scanning direction can be estimated in the following way. Measurement should be made on the position deviation Dss of the line width slanted 45 degrees in the sub-scanning direction to the horizontal direction. FIG. 16 depicts diagrams illustrating an example of the elimination of the position deviations. First, the standard pattern position detecting means 109 detects the center positions of the cyan slanted line 163 and the magenta slanted horizontal line 164 in the same image. An ideal distance Lssm is calculated from difference of line addresses LAD. Second, the output image density measuring means 111 detects an actual distance Lss. The image quality judging means 112 calculates a position deviation Dss in the sub-scanning direction equal to the difference (Lss–Lssm). The position deviation Dm in the main scanning direction should be calculated by Dm=Dss–Ds or estimated by experiment.

Further, if the image density measuring device 608 is made up of a known color CCD, color data can be obtained for each standard pattern. This makes it possible to make color conversion and {SYMBOL 103 \f "Symbol"} correction for each standard pattern. The previous color conversion and {SYMBOL 103 \f "Symbol"} correction are made without relation to the image pattern. To make the color printer reproduce the color specified by the RGB data, for example, the color must be converted to data of CMYK that are basic colors for color printer byway of the color conversion and {SYMBOL 103 \f "Symbol"} correction. The prior art has the standard patterns of solid images singularly converted with no relation to an image pattern although the standard patterns of solid images are provided on the photosensitizing drum 101 and a conversion equation is successively updated. The conversion equation for writing the solid image, however, must be replaced by one for a thin line. The third embodiment checks color developments of the standard patterns and updates the conversion equations for the color conversion and {SYMBOL 103 \f "Symbol"} correction to accomplish more exact color reproduction.

Figure 12:
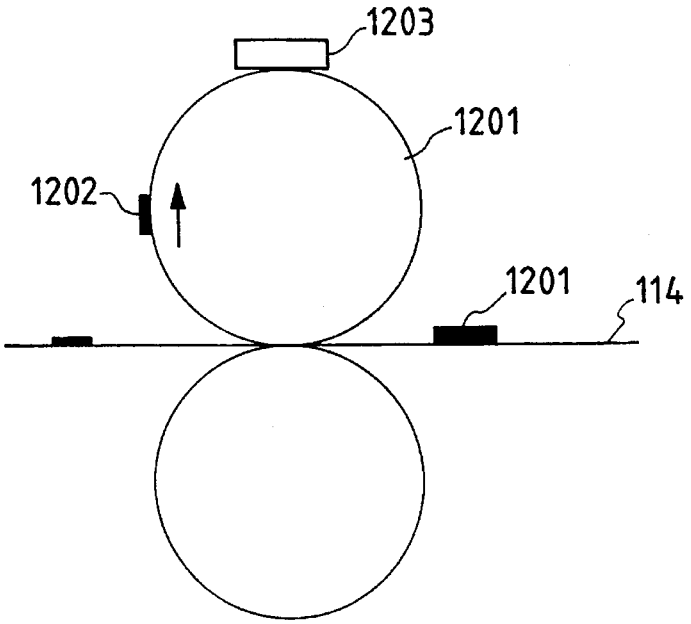
FIG. 12 is a cross-sectioned view illustrating a fixing arrangement of the present invention.
Figure 13:
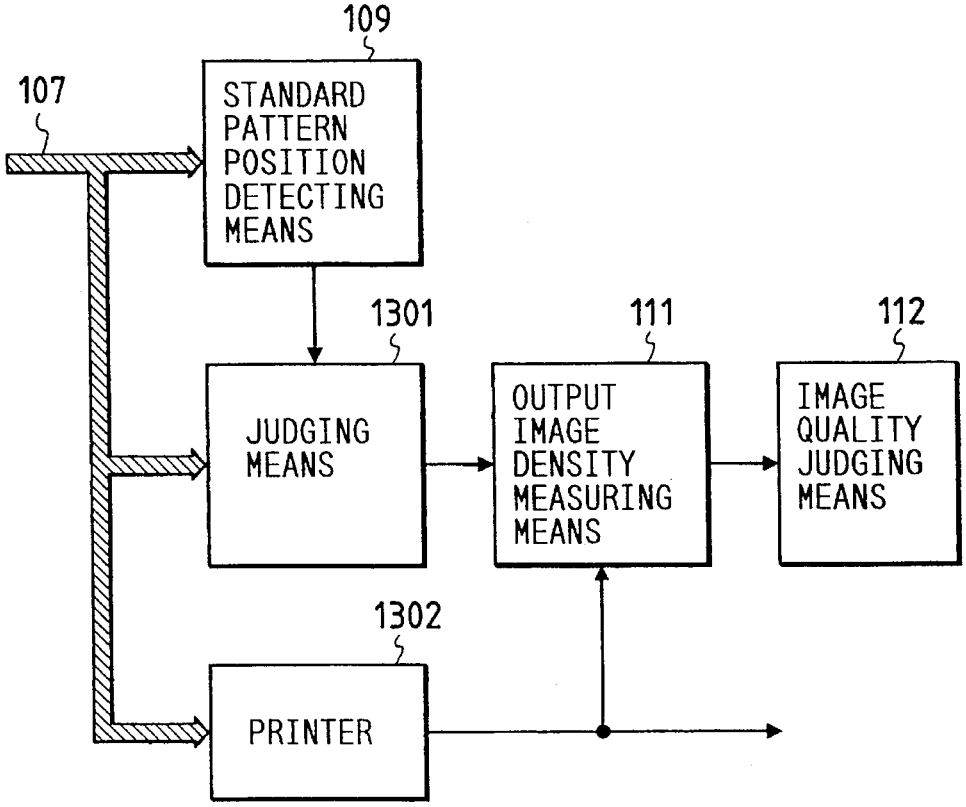
FIG. 13 is a block diagram illustrating an offset measuring device of the present invention.

The following describes in detail a fourth embodiment according to the present invention by reference to FIGS. 12 and 13. FIG. 12 depicts a cross-sectioned view illustrating the structure of the fixing arrangement 106 for the fixing process. The fixing arrangement 106 melts unfixed toner 1201 on the recording paper 114 with heat and pressure to make solid on the recording paper 114. The heat given to the unfixed toner 1201 must be optimized. The heat, if it is too high or too low, causes offset. The offset is a phenomenon where parts of the toner melted in the fixing process adhere to heat roller 1201 having a heat source thereinside. The heat roller 1201 having the toner adhered thereto is cleaned by a cleaner 1203 mounted around the heat roller. However, the parts on the heat roller are turned once before adhering to the recording paper 114 again. The offset is a fatal detect of the printer because it does not only lowers the density of the image having the toner deprived by the heat roller 1201, but also causes the adhesion of the offset toner from the heat roller to make erroneous printing. The offset differs depending on the machine model and on the kind of image, for example, likely appearing on a horizontal line rather than a vertical or likely appearing on a particular line width. FIG. 13 depicts a block diagram a configuration of an offset measuring device. The standard pattern position detecting means 109 has inferior patterns that mostly cause the offset incorporated therein as standard patterns. The standard pattern position detecting means 109 detects the inferior patterns from the input image signal 107 before signaling the pattern position to a solid white pattern judging means 1301. The solid white pattern judging means 1301 extracts from the input image signal 107 a local image at a position downstream by a circumference length of the heat roller at the pattern position. If the local image is the solid white image pattern, that position is signaled to the output image density measuring means 111 as an offset measurement portion. The output image density measuring means 111 measures densities of the offset measurement portion of the output image 108 recorded by a laser printer 1302. The image quality judging means 112 take the average densities of the. If the average density is denser than the ordinary solid white image density, the image quality judging means 112 judges that the offset occurs. The fourth embodiment can quantitatively measure only the offset without being affected by the other processes. Phenomena similar to the offset include poor cleaning of the standard pattern position table 110 and the transferrer 802, and a memory effect of the photosensitizing drum 101. The poor cleaning is a phenomenon that occurs as follows. The toner image on the standard pattern position table 110 or the transferrer 802 is completely transferred. The remaining image cannot be completely eliminated by the cleaner. If the remaining image portion becomes an area to be exposed, like the solid black or halftone, in the exposing process 103 in the next process, the exposure cannot be fully made so that the area is lowered in the density. The memory effect is a phenomenon where an effect of the electrostatic latent image written on the photosensitizing drum 101 is not electrically deleted completely, but appears in the next electrostatic latent image. The fourth embodiment can measure the poor cleaning and the memory effect by replacing the heat roller by the photosensitizing drum 101 or the transferrer 802 in a similar way. The resulted data can be used to correct the poor cleaning and the memory effect, and to issue an alarm.

Figure 17:
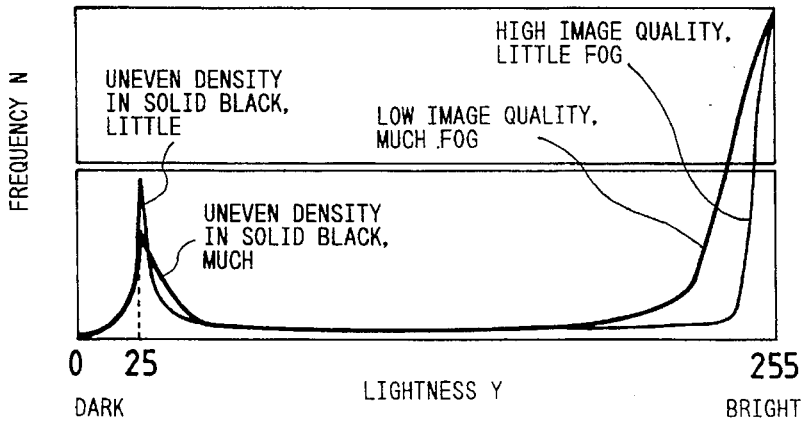
FIG. 17 is a graph illustrating frequency data of lightness of the present invention.

The following describes in detail a fifth embodiment according to the present invention by reference to FIGS. 8, 17, and 18, and Table 3. In the second embodiment described by FIG. 8, the standard pattern position detecting means 109 generates the standard pattern position table 110 shown in Table 1. The input image signal 107 usually recorded, however, contains a great number of the solid white patterns shown in FIG. 4 (4). Density of fog that is used to evaluate the solid white is usually very low, the fog being a phenomenon where small amounts of toner adhere to areas to which the toner must not be adhered in itself. If the local image 301 is measured, therefore, error the becomes so large that appropriate image quality control is difficult. This difficulty can be solved by measuring densities of the solid white of wide area before taking the average of the densities. However, the technique of accumulating positions of the local images 301 one by one into the standard pattern position table 110 as in the second embodiment is not efficient, takes long process time, and requires large memory capacity. The fifth embodiment therefore creates a standard pattern frequency table shown in Table 3 in place of the standard pattern position table 110 in Table 1.

TABLE 3

| Page No. | Standard Pattern No. in FIG.4 | Frequency of local image 301 |
|---|---|---|
| n | (1) | N1 |
| | (2) | N2 |
| | (3) | N3 |
| | (4) | N4 |
| | (5) | N5 |
| | Total | Nt |

That is, the appearance frequencies of the standard patterns in FIG. 4 are counted. The results are fed to the image quality judging means 112. The output image density measuring means 111 creates a so-called histogram of frequency data of every lightness or density, The results are fed to the image quality judging means 112. FIG. 17 depicts curves illustrating an example of frequency data of lightness. In the figure, if the standard pattern frequency table of the image measured chiefly contains a solid white area of 80%, a solid black area of 15%, and other areas of narrower than 5%, then $$100\cdot(N1+N4)/Nt>95,$$

where symbols are given in Table 3.

The frequency data of every lightness from the output image density measuring means 111, as shown in FIG. 17, are distributed to two extremes, around a bright solid white lightness range and around a dark solid black lightness range. A thin curve in the figure indicates a high quality image of low fog density and a thick curve is a low quality image of high fog density. The image quality judging means 112 measures the fog density in the following practice.

The image quality judging means 112 measures the fog density from the frequency distribution around the solid white lightness range. The fifth embodiment estimates the fog density by ratio of a total frequency N(128–252) of the lightness of 128 to 252 to a total frequency N(128–255) of the lightness of not less than 128. That is, the fog density is given by:

$$N(128-252)/N(128-255).$$

Similarly, density unevenness in the solid black is measured from the frequency distribution around the solid black lightness range by that practice. The thin curve in FIG. 17 indicates a high quality image of little density unevenness in the solid black and the thick curve is a low quality image of much density unevenness in the solid black. A peak of the solid black lightness of the high quality image of little density unevenness is at lightness of 25. The density unevenness is generally distributed rather in the high lightness range than at the peak. The fifth embodiment estimates the density unevenness in the solid black by a ratio of a total frequency N(28–127) of the lightness of 28 to 127 to a total frequency N(0–127) of the lightness of not higher than 127. That is, the density unevenness in the solid black is given by:

$$N(28-127)./N(0-127)$$

The image quality judgement result 115 is fed to the process controlling means 113. Description of the process controlling means 113 is omitted since it is the same as in the first embodiment.

As described so far, the fifth embodiment measures the averages of the fog concentrations and the density unevennesses in the solid blacks in the entire image that are little in the changes in the local areas. The embodiment therefore makes it possible to measure the image quality at high accuracy. The measurements can be used to accomplish the high image quality. The other standard patterns to be measured include the solid black and halftone of the colors.

There is a prior technique of anticipating the of the toner consumed in printing the image by counting the number of the black pixels of the input image signal 107. However, the technique cannot anticipate the accurate amount of the consumed toner because the amount of the toner adhered to for a single pixel differs with the image pattern. If the fifth embodiment makes use of the standard pattern frequency table shown in Table 3, the accurate amount of the consumed toner can be anticipated.

First, the amount of the toner adhered to the single pixel for each standard pattern is measured in advance. Let the amount K[mg/pixel] of the toner adhered to the single pixel of the solid black image be 1. Also, let Tci denote the ratio of the amount of the toner adhered to the single pixel of the other standard patterns to the amount K[mg/pixel], where i is the standard pattern number in FIG. 4. The ratio Tci is low in the solid black image, while it is high in the line figure. Let T[mg] denote amount of toner per image. The amount T[mg] is given by $$T=Nt\cdot K\cdot(R1+R2\cdot Tc2+R3\cdot Tc3+\ldots)$$

where Ri=Ni/Nt. The equation makes it possible to anticipate the accurate amount of the consumed toner for each image. The accurate anticipation allows supply of toner so appropriately that high quality image can be obtained.

As described so far in detail, the present invention can measure the image quality of most desired patterns to evaluate without creating the standard pattern for measuring the image quality of most desired patterns to evaluate with the toner image. The present invention therefore saves on the use of toner, paper, and cleaner, and needs not take specific times for the measurements. The present invention also can measure the color images and can detect the color deviations and position deviations for correction. The present invention further can detect the standard pattern before making pattern recognition to measure the offset in the fixing process and the memory effect of the photosensitizer.

What is claimed is:

1. An image recording apparatus for recording visible images on a recording medium by way of successively inputting electric image signals forming the visible images, comprising:

a first standard pattern detector detecting one of a plurality of standard patterns from the input electric image signals;

an image density measuring device measuring density of a visible image recorded on the recording medium corresponding to the detected standard pattern;

an image quality judging device judging image quality of the recorded visible image corresponding to the detected standard pattern on the basis of an output from said image density measuring device, and a process controller deciding process parameters on the basis of signals output from said image quality judging device before controlling image quality of a visible image using the process parameters.

2. The image recording apparatus of claim 1, wherein:

said first standard pattern detector detects a standard pattern from the input electric image signals, and thereby feed out a recording position of the standard pattern on the recording medium; and said image density measuring device measures densities of the output visible image on the basis of data of the position of the standard pattern in the image.

3. The image recording apparatus of claim 1, wherein:

said first pattern detector detects a standard pattern from the input electric image signals to feed out appearance frequencies of the standard pattern on the recording medium; and said image density measuring device measures a density of entire area of the output visible image to feed out a histogram of densities.

4. The image recording apparatus of claim 3, wherein said image quality judging device has a pattern selector selecting kinds of standard patterns to be measured by the appearance frequencies of the standard patterns on the recording medium to judge the image qualities from the histogram of every density around densities of the selected standard patterns.

5. The image recording apparatus of claim 3, wherein said image quality judging device adds products of area ratios of the standard patterns on the recording medium multiplied by amounts of toner consumption for single pixels of the standard patterns respectively and further multiples the products by the number of all pixels, whereby an amount of the toner consumption for the single image is detected.

6. The image recording apparatus of claim 1, further comprising:

a second standard pattern detector placed at a position away a certain distance or time from a position of said first standard pattern detector.

7. The image recording apparatus of claim 6, wherein:

the standard patterns used by said first standard pattern detector are patterns for detecting offsets and poor cleaning in a fixing process and a memory effect of a photosensitizer; and the standard patterns used by said second standard pattern detector are solid white.

8. The image recording apparatus of claim 6, wherein the certain distance of the placement of said second standard pattern detector is a circumference length of a heat roller of a fixing arrangement toward a downstream of the recording paper, or is a circumference length of a photosensitizer or a transferrer.

9. An image quality control apparatus of an apparatus that records full-color visible images on a recording medium by way of entering a plurality of electric image signals corresponding to respective colors forming the visible full-color images, comprising:

a standard pattern detector detecting positions of single-color standard patterns relating to a color selected from the input electric color image signals;

an image density measuring device measuring densities of single-color images provided by recording the single-color standard pattern on the recording medium on the basis of the position data;

an image quality judging device judging image quality of the visible images recorded corresponding to a standard pattern on the basis of output from said image density measuring device; and a process controller deciding process parameters on the basis of signals output from said image quality judging device before controlling image quality of a visible full-color image using the process parameters.

10. The full-color images recording apparatus of claim 9, wherein:

said standard pattern detector detects the positions of the single-color standard patterns of vertical single lines and horizontal single lines from the input electric color image signals; and said image quality judging device detects horizontal and vertical widths of the single-color vertical single lines and horizontal single lines.

11. The full-color images recording apparatus of claim 9, wherein:

said standard pattern detector detects the positions of the single-color standard patterns of vertical single lines and horizontal single lines from the input electric color image signals; and said image quality judging device detects vertical and horizontal position deviations of the single-color images on the basis of center positions of the vertical single lines and horizontal single lines.

12. The full-color images recording apparatus of claim 10 or 11, wherein:

said standard pattern detector detects positions of the single-color standard patterns of the horizontal single lines and single slanted lines from the input electric color image signals; and said image density measuring device measures density of the single-color developed images on the basis of the position data.

13. An image quality control method in a process for recording a visible image on a recording medium by an image recording apparatus, comprising the steps of:

receiving external electric image signals;

detecting standard patterns from the electric image signals;

judging image qualities from image densities of the visible image on the recording medium obtained by recording the extracted standard patterns; and controlling image recording processes on the basis of results of said judging step.

* * * * *

UNITED STATES PATENT AND TRADEMARK OFFICE

CERTIFICATE OF CORRECTION

PATENT NO. : 5,576,811

DATED : November 19, 1996

INVENTOR(S) : Shinya KOBAYASHI et al.

It is certified that error appears in the above-indentified patent and that said Letters Patent is hereby corrected as shown below:

| Column | Line | |
|---|---|---|
| 1 | 49 | Change "note" to --not--. |
| 2 | 2 | Change "a image" to --an image--. |
| 2 | 25 | Change "knows with" to --can discern--. |
| 2 | 26 | Change "comes" to --adjusts itself--. |
| 2 | 51 | After "For" change "the" to --this--. |
| 2 | 54 | Before "they" delete "the". |
| 4 | 12 | Change "a output" to --an output--. |
| 4 | 14 | After "6" insert --show--. |
| 4 | 32 | Change "An pixel" to --A pixel--. |
| 5 | 38 | Change "an" to --a--. |
| 5 | 64 | After "shown" delete "a". |
| 6 | 43 | After "completed" insert --,--. |

UNITED STATES PATENT AND TRADEMARK OFFICE

CERTIFICATE OF CORRECTION

PATENT NO. : 5,576,811

DATED : November 19, 1996

INVENTOR(S) : Shinya KOBAYASHI et al.

It is certified that error appears in the above-indentified patent and that said Letters Patent is hereby corrected as shown below:

| Column | Line | |
|---|---|---|
| 8 | 60 | After "5" insert --pixels--. |
| 8 | 61 | After "not" delete "to". |
| 10 | 28 | Change "ends life" to --has ceased functioning--. |
| 10 | 49 | Before "low" change "in" to --because of--. |
| 10 | 64 | After "104k." delete "and". |
| 11 | 6 | Change "at a time" to --simultaneously--. |
| 12 | 4 | Change "in" to --for--. |
| 13 | 19 | Delete "made up of in a way" and insert therefor --designed so--. |
| 14 | 7 | Change "make solid" to --solidify the toner--. |
| 14 | 16 | Delete "does". |

UNITED STATES PATENT AND TRADEMARK OFFICE

CERTIFICATE OF CORRECTION

PATENT NO. : 5,576,811

DATED : November 19, 1996

INVENTOR(S) : Shinya KOBAYASHI et al.

It is certified that error appears in the above-indentified patent and that said Letters Patent is hereby corrected as shown below:

| Column | Line | |
|---|---|---|
| 15 | 7 | Replace "must not be adhered in itself." with --should not adhere.--. |
| 15 | 8 | Change "error the" to --the error--. |
| 16 | 53 | Change "needs not" to --does not need to--. |
| 17 | 15 | Change "feed" to --feeds--. |
| 17 | 40 | Change "multiples" to --multiplies--. |

Signed and Sealed this

Tenth Day of June, 1997

Bruce Lehman

*Attest:*

BRUCE LEHMAN

*Attesting Officer*

*Commissioner of Patents and Trademarks*